US007048639B2

(12) United States Patent
Grace

(10) Patent No.: US 7,048,639 B2
(45) **Date of Patent: *May 23, 2006**

(54) HIGH MOMENT OF INERTIA PUTTER

(75) Inventor: Robert M. Grace, St. Pete Beach, FL (US)

(73) Assignee: MacGregor Golf Company, Albany, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/771,115

(22) Filed: Feb. 4, 2004

(65) Prior Publication Data

US 2004/0166953 A1 Aug. 26, 2004

Related U.S. Application Data

(63) Continuation of application No. 10/248,342, filed on Jan. 10, 2003.

(51) Int. Cl.
*A63B 69/36* (2006.01)
*A63B 53/04* (2006.01)
*A63B 53/06* (2006.01)

(52) U.S. Cl. ..... 473/251; 473/335; 473/338; 473/339; 473/340; 473/349

(58) Field of Classification Search ..... 473/324–350, 473/231–256, 290–291; D21/736–746
See application file for complete search history.

(56) References Cited

U.S. PATENT DOCUMENTS 1,901,562 A * 3/1933 Main ..... 473/330
2,954,231 A 9/1960 MacIntyre
2,957,696 A 10/1960 Warpotas
3,042,405 A 7/1962 Solheim
3,143,349 A 8/1964 MacIntyre
3,770,279 A 11/1973 Phinny
D234,960 S 4/1975 Swash
D234,961 S 4/1975 Swash
D234,962 S 4/1975 Swash
3,966,210 A * 6/1976 Rozmus ..... 473/341
4,010,958 A 3/1977 Long
4,828,266 A * 5/1989 Tunstall ..... 473/336
4,898,387 A * 2/1990 Finney ..... 473/341
D320,251 S 9/1991 Mermillod
D320,638 S 10/1991 Mermillod
5,058,895 A 10/1991 Igarashi
5,080,365 A 1/1992 Winchell
5,082,277 A 1/1992 Gingold
5,344,151 A 9/1994 Anderson et al.
5,433,444 A * 7/1995 Chiuminatta et al. ..... 473/240

(Continued)

*Primary Examiner*—Sebastiano Passaniti
(74) *Attorney, Agent, or Firm*—Buchanan Ingersoll

(57) ABSTRACT

A golf putter head has a generally triangular shape where a ball-striking leading wall has a first breadth greater than a second breadth of a trailing wall. The leading wall and trailing wall are interconnected at their respective opposite ends by sidewalls that converge toward one another and define a cavity having a trapezoidal shape. The center of gravity of the golf putter head is closer to the trailing wall than the leading wall so that a moment of inertia is generated that reduces the effects of missing a sweet spot on the leading wall during a putt. In a second embodiment, the trailing wall is weighted to move the center of gravity still closer to the trailing wall. In a third embodiment, a web interconnects the leading and trailing walls along a longitudinal axis of the golf putter head, dividing the cavity into two equal-sized cavities.

46 Claims, 4 Drawing Sheets

U.S. PATENT DOCUMENTS

| | | | | |
|---|---|---|---|---|
| D364,907 | S | 12/1995 | Estridge et al. | |
| 5,544,879 | A * | 8/1996 | Collins | 473/314 |
| 5,564,990 | A | 10/1996 | Weeks | |
| 5,620,379 | A | 4/1997 | Borys | |
| 5,630,765 | A | 5/1997 | Moore | |
| 5,685,784 | A | 11/1997 | Butler | |
| 5,830,078 | A | 11/1998 | McMahan | |
| 5,871,407 | A * | 2/1999 | Tseng | 473/328 |
| 6,059,669 | A | 5/2000 | Pearce | |
| 6,080,070 | A | 6/2000 | Whitley | |
| 6,244,974 | B1 | 6/2001 | Hanberry, Jr. | |
| 6,267,689 | B1 | 7/2001 | Ambrose | |
| D460,990 | S | 7/2002 | Jung | |
| 6,471,600 | B1 | 10/2002 | Tang et al. | |
| 6,488,595 | B1 | 12/2002 | Grace | |
| 6,929,564 | B1 * | 8/2005 | Olsavsky et al. | 473/340 |
| 2003/0092503 | A1 | 5/2003 | Snowdon | |
| 2003/0144077 | A1 | 7/2003 | Cullen | |
| 2003/0228925 | A1 | 12/2003 | Rohrer | |
| 2003/0232661 | A1 | 12/2003 | Greer, Jr. | |
| 2003/0236130 | A1 | 12/2003 | Gammon, Jr. | |
| 2005/0137027 | A1 * | 6/2005 | Thomas | 473/340 |

* cited by examiner

HIGH MOMENT OF INERTIA PUTTER

This application is a continuation application of application Ser. No. 10/248,342, filed Jan. 10, 2003, the entire content of which is hereby incorporated by reference.

BACKGROUND OF INVENTION

1. Field of the Invention

This invention relates, generally, to golf putters. More particularly, it relates to a golf putter of generally triangular configuration having a high moment of inertia.

2. Description of the Prior Art

In a perfect putt, the golfer strikes the ball exactly on the sweet spot of the putter head. This prevents the putter head from twisting about the axis defined by the golf club shaft. However, when the sweet spot is missed, the inertia offered by the ball imparts a torque to the golf club shaft. The torque increases in direct proportion to the distance by which the sweet spot is missed.

A putter head having a high moment of inertia resists the torque caused by missing the sweet spot. Putter heads having high moments of inertia are typically very wide and have weights attached to their outermost points. Most golfers prefer to play, however, with normal-sized, attractive putter heads rather than obviously over-sized putter heads.

Accordingly, there is a need for an attractive golf club putter head having a substantially normal width or breadth that provides a very high moment of inertia.

However, in view of the prior art considered as a whole at the time the present invention was made, it was not obvious to those of ordinary skill in the pertinent art how such need could be fulfilled.

SUMMARY OF INVENTION

The long-standing but heretofore unfulfilled need for a golf putter head of acceptable size that provides a high moment of inertia is now met by a new, useful, and nonobvious invention. The novel golf putter head includes a main body having a generally triangular configuration. A leading wall of the main body has a first breadth, a top edge and a bottom edge. A trailing wall of the main body has a second breadth less than said first breadth, a top edge, and a bottom edge.

A first sidewall interconnects a first end of the leading wall and a first end of the trailing wall. A second sidewall interconnects a second end of the leading wall and a second end of the trailing wall.

A soleplate interconnects the bottom edge of the leading wall and the bottom edge of the trailing wall. The soleplate has a breadth less than the breadth of the trailing wall. The soleplate is normal to the leading wall and the trailing wall and has a length greater than the breadth of the leading wall.

A cavity is formed in the main body, bounded on four sides by the leading wall, the trailing wall, the first sidewall, and the second sidewall. The cavity is unbounded on a top end and is partially bounded on a lower end by the soleplate.

The trailing wall is spaced in trailing relation to the leading wall by a sufficient distance to position a center of gravity of the putter head about two-thirds of the way between the leading wall and the trailing wall. Accordingly, the center of gravity is closer to the trailing wall than to the leading wall. Such positioning of the center of gravity provides an enhanced moment of inertia to minimize the effects of a putt that misses a sweet spot on a ball-striking surface that is adapted to be mounted to the leading wall.

In a second embodiment, a weight-receiving cavity is formed in a trailing part of the putter head. The trailing part of the putter head is defined as the part between the trailing wall of the putter head and the respective trailing ends of the cavity.

A weight means is positioned within the cavity to further enhance the moment of inertia by positioning the center of gravity further away from the leading wall and closer to the trailing wall.

In the preferred embodiment of the invention, an upstanding web is disposed in interconnecting relation between the leading wall and the trailing wall. The web is disposed normal to the leading wall and the trailing wall. The cavity is therefore divided into two cavities by the web. Thus, the web transmits forces applied to the leading wall at least in part to the trailing wall so that resistance offered by the trailing wall supplements resistance offered by the leading wall to the applied forces.

The soleplate is centered on a longitudinal axis of symmetry of the golf putter head and the web is mounted in upstanding relation to the soleplate. More particularly, the web is disposed on the longitudinal axis of the golf putter head and divides the cavity into two cavities of equal size.

An important object of this invention is to provide a golf putter head having a moment of inertia greater than 4,000 gm $cm^2$. A closely related object is to accomplish the foregoing object in a putter head that is light-in-weight and inexpensive to manufacture.

Another important object is to provide a high moment of inertia putter head having an acceptable, aesthetically-pleasing size.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
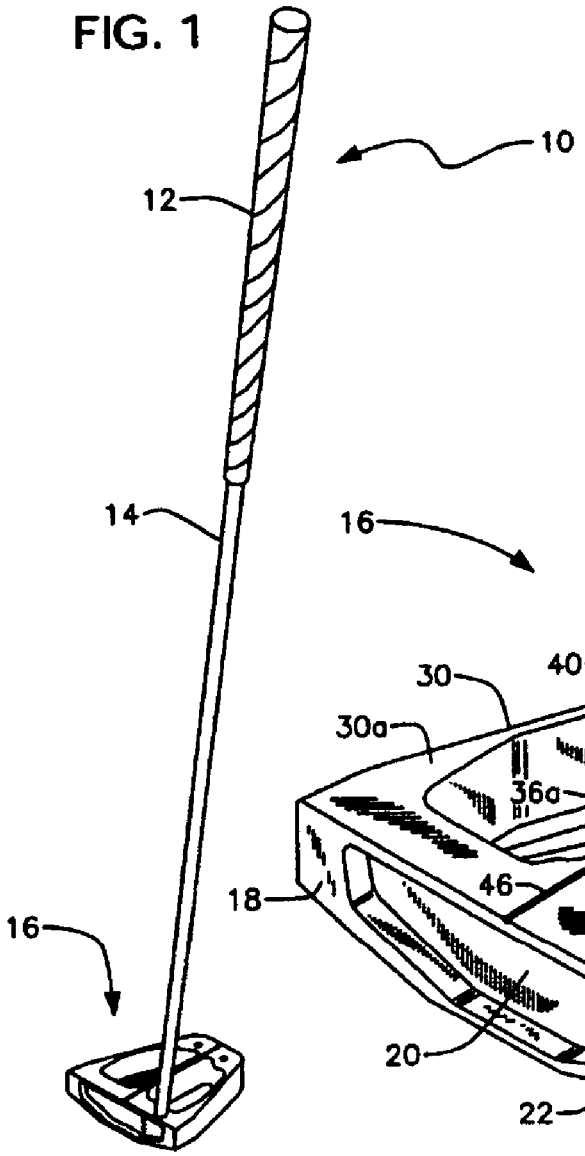
FIG. 1 is a perspective view of a putter equipped with the novel putter head.

Referring to FIG. 1, it will there be seen that the reference numeral 10 denotes an illustrative embodiment of the present invention as a whole.

Golf putter 10 includes grip 12, shaft 14, and novel putter head 16.

Figure 2:
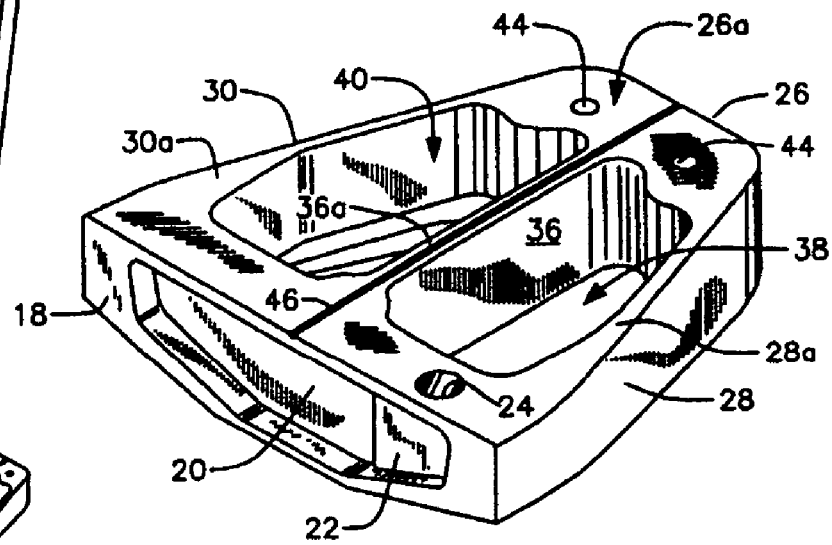
FIG. 2 is a perspective view of a first embodiment of the novel putter head.
Figure 3:
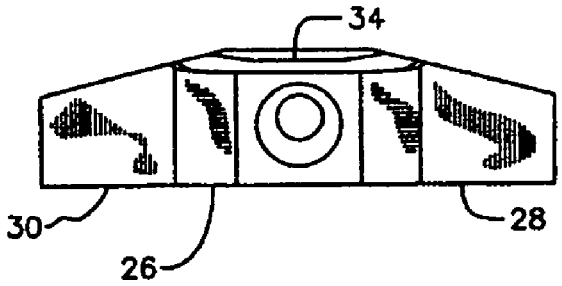
FIG. 3 is a rear elevational view of said first embodiment.

As best depicted in FIG. 2, novel putter head 16 includes transversely disposed leading wall 18 having recess 20 formed therein for receiving a ball-striking insert, not shown. Recess 20 has less depth at its right end 22 to provide increased structural support for the leading end of shaft 14, said leading end being received within blind bore 24.

In a preferred embodiment, the breadth of leading wall 18 is only four inches (4"). This distinguishes putter head 16 from any high moment of inertia putter head that relies upon a very wide, unaesthetic leading wall.

Golf putter head 16 further includes transversely disposed trailing wall 26 that is parallel with leading wall 18. The breadth, width, or transverse extent of leading wall 18 is greater than the breadth, width, or transverse extent of trailing wall 26.

As perhaps best understood by considering FIGS. 2–5 together, first sidewall 28 interconnects a first end of leading wall 18 and a first end of trailing wall 26. Second sidewall 30 interconnects a second end of leading wall 18 and a second end of trailing wall 26. Accordingly, sidewals 28 and 30 converge toward one another from said leading wall to said trailing wall. As best indicated in the top plan view of FIG. 4, the novel structure creates a generally triangular-shaped putter head; more accurately, the shape is that of a trapezoid with rounded corners.

Note that the longitudinal extent from leading wall 18 to trailing wall 26 is greater than the transverse extent of said leading wall 18. It is also worth observing that trailing wall 26 is centered with respect to the sweet spot of the putter head, rearwardly thereof, and has a truncate breadth so that its opposite ends are positioned close to the longitudinal axis of symmetry of the putter head, it being understood that said sweet spot is centered on said longitudinal axis of symmetry.

Figure 4:
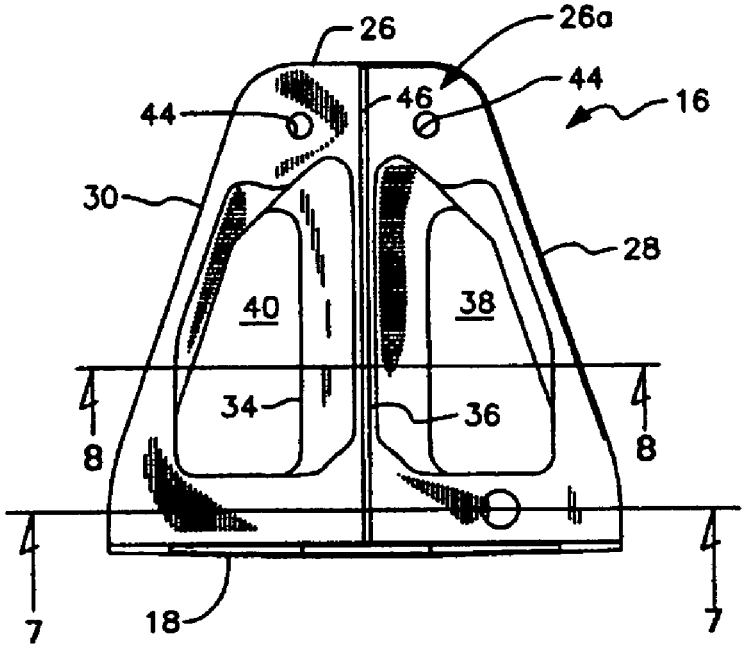
FIG. 4 is a top plan view thereof.
Figure 5:
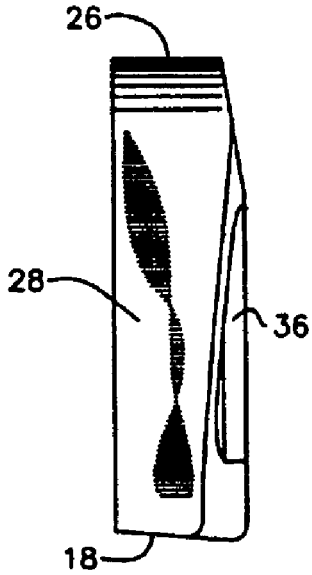
FIG. 5 is a side elevational view thereof.
Figure 6:
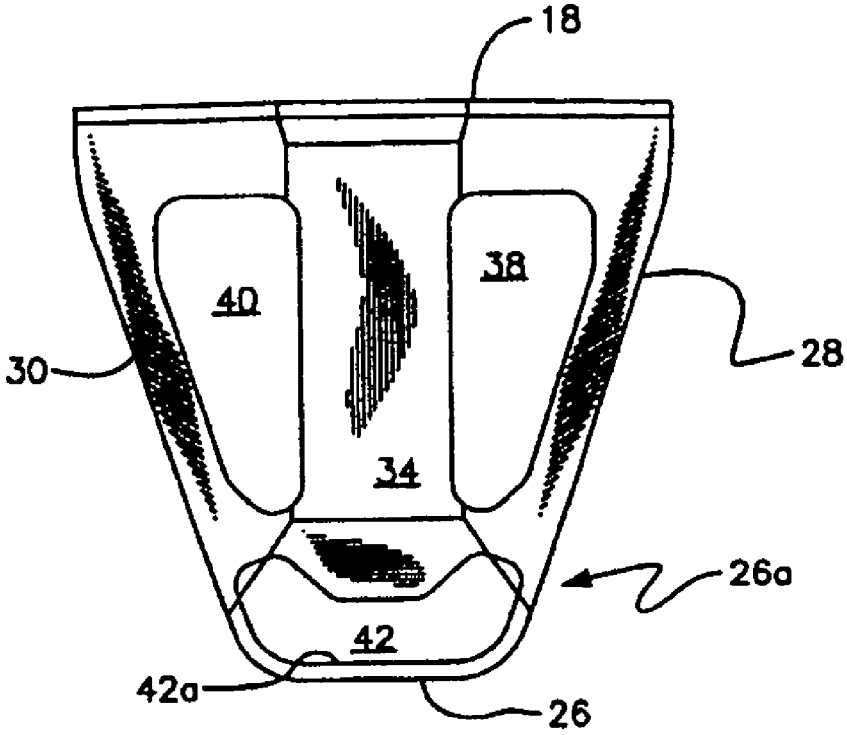
FIG. 6 is a bottom plan view thereof.
Figure 7:
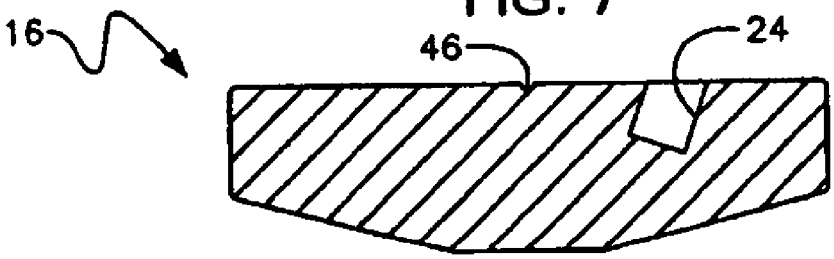
FIG. 7 is a transverse sectional view taken along line 7—7 in FIG. 4.
Figure 8:
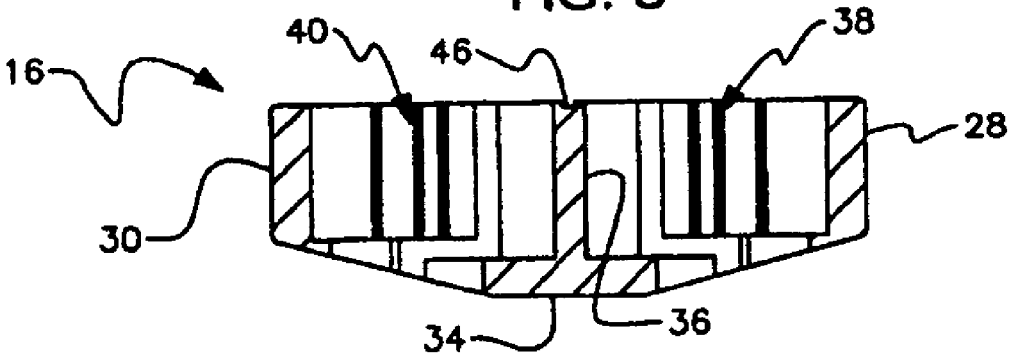
FIG. 8 is a transverse sectional view taken along line 8—8 in FIG. 4.

Soleplate 34, best seen in FIGS. 4 and 6, is disposed in interconnecting relation between leading wall 18 and trailing wall 26 and is centered with a longitudinal axis of symmetry of golf putter head 16. More particularly, soleplate 34 interconnects a bottom edge of leading wall 18 and a bottom edge of trailing wall 26. Forces applied to leading wall 18 are transmitted to trailing wall 26 by said soleplate and by sidewalls 28, 30 as well.

Upstanding web 36 is mounted on and projects upwardly from soleplate 34 and is coincident with the longitudinal axis of symmetry of putter head 16. Top edge 36*a* of web 36 is flush with top edge 28*a* of sidewall 28 and top edge 30*a* of sidewall 30.

With the exception of soleplate 34 and web 36, the space peripherally bounded by leading wall 18, trailing wall 26, and sidewalls 28, 30 is empty, i.e., putter head 16 is substantially of hollow construction. Thus it is understood that web 36 divides that hollow space into cavities 38 and 40. Cavities 38, 40 reduce the weight of putter head 16 and enable the center of gravity of said putter head to be positioned on the trailing side of leading wall 18.

Cavities 38, 40 do not extend all the way to trailing wall 26. Thus, a large part of the mass of putter head 16 is provided in trailing end 26*a* thereof, thereby positioning the center of gravity of putter head 16 in trailing relation to the leading wall 16. This increases the moment of inertia of the putter head. If putter head 16 is made of a single material, such as stainless steel, the moment of inertia will still be high but will be less than a moment of inertia achieved by weighting said trailing end 26*a*.

The center of gravity is moved further from leading wall 18, and the moment of inertia thereby increased, by adding a weight means to trailing end 26*a*. A weighted putter head represents the second embodiment of this invention. Such a weight means is denoted 42 in FIG. 6. Cavity 42*a* is milled into trailing end 26*a* to accommodate said weight means, and said weight means is flush with the top of cavity 42*a* when the weight means is secured therewithin by suitable fastening means such as fasteners 44, 44 (FIGS. 2 and 4).

Where weight means 42 is formed of copper, the moment of inertia of putter head 16 is approximately 5860 gm $cm^2$. Where weight means 42 is formed of a 25/75 copper/tungsten mixture, the moment of inertia is about 6800 gm $cm^2$, and where weight means 42 is formed of tungsten only, the moment of inertia is about 7200.

Where weight means 42 is formed of copper, the center of gravity of putter head 16 is positioned about 60% of the distance from leading wall 18 to trailing wall 26. Where weight means 42 is formed of a 25/75 copper/tungsten mixture, the center of gravity is positioned about 70% of the distance from leading wall 18 to trailing wall 26, and where weight means 42 is formed of tungsten only, the center of gravity is positioned about 78% of the distance from leading wall 18 to trailing wall 26 Groove 46 is formed in the top of putter head 26 and extends from the top edge of leading wall 18 to the top edge of trailing wall 26, along the top edge of web 36. Said groove 46 thus is coincident with a longitudinal axis of putter head 16 and provides a sighting line that a golfer may use when lining up a putt.

Figure 9:
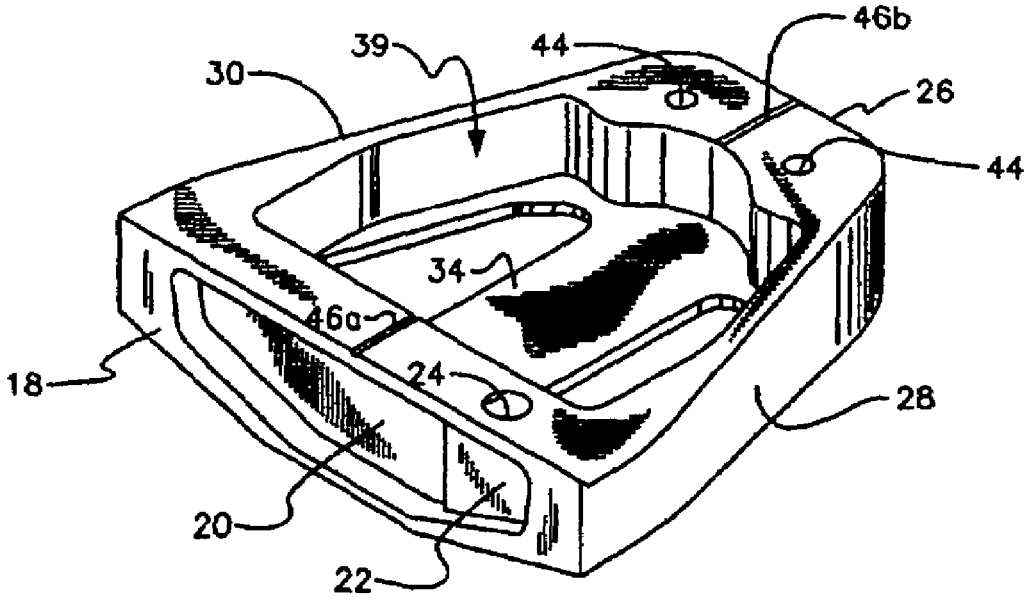
FIG. 9 is a top perspective view of a second embodiment.
Figure 10:
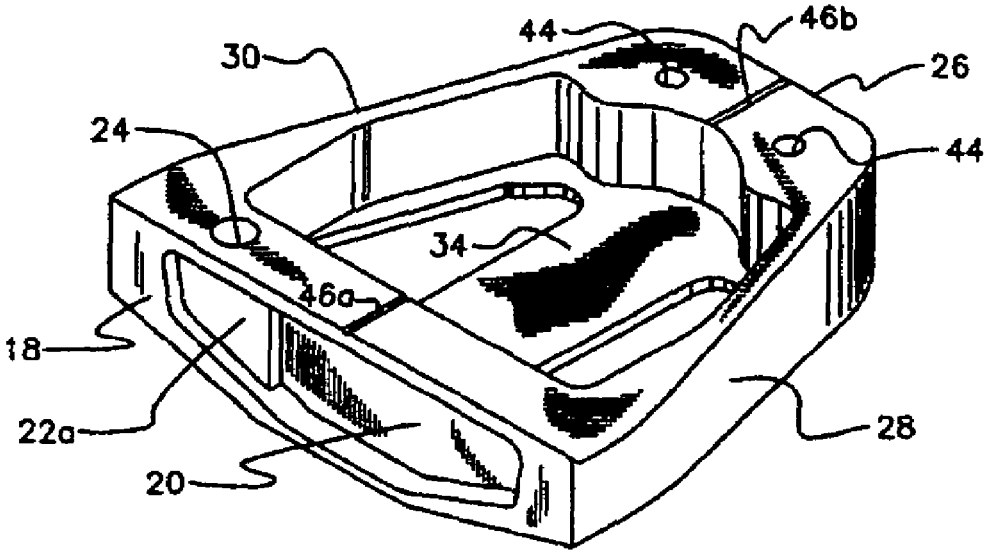
FIG. 10 is a top perspective view of a putter head of the second embodiment for a left-handed golfer.

In a third embodiment, depicted in FIGS. 9 and 10, web 36 is obviated and a single cavity 39 is thereby provided. Thus, groove 46 is broken up into truncate leading part 46*a* and truncate trailing part 46*b*, but said truncate parts still collectively provide a sighting line that a golfer can use when lining up a putt.

The elimination of web 36 moves the center of gravity still further to the trailing side of leading wall 18, relative to the first two embodiments, and the moment of inertia may therefore be increased further still, depending upon whether a weight means is added to trailing part 26*a* as in the second embodiment hereof.

FIG. 10 also indicates that strengthening insert 22*a* is moved to an opposite end of recess 20 for a left-handed golfer, and that blind bore 24 is re-positioned as well.

The high moments of inertia of achieved by these embodiments of the inventive putter head have never before been achieved in a golf putter having a leading wall that is only four inches (4') in breadth or in a golf putter head that weighs under 350 grams or in a putter head of such an acceptable size.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

The invention claimed is:

1. A golf putter head, comprising:

a leading section for striking a golf ball, said leading section having a first breadth;

a trailing section having a second breadth that is less than said first breadth;

a first wall that connects a first end of said leading section with a first end of said trailing section;

a second wall that connects a second end of said leading section with a second end of said trailing section;

said leading section, said trailing section, said first wall, and said second wall defining a triangular-shape of said golf putter head;

a web normal to a longitudinal axis of said leading section and that connects said leading section and said trailing section, said web being located along an axis of symmetry of said putter head;

a weight means located at said trailing section and along said axis of symmetry;

a first cavity for reducing a weight of said golf putter head at an area between said leading section and said trailing section;

said first cavity being located on a first side of said web and between said leading section and said trailing section;

said first cavity being at least partially bounded by said first wall and said web;

said first cavity being at least partially unbounded at a top side of said golf putter head;

said first cavity being at least partially unbounded at a bottom side of said golf putter head;

a second cavity for reducing a weight of said golf putter head at another area between said leading section and said trailing section;

said second cavity being located on a second side of said web that is opposite from said first side of said web, said second cavity being located between said leading section and said trailing section;

said second cavity being at least partially bounded by said second wall and said web;

said second cavity being at least partially unbounded at a top side of said golf putter head;

said second cavity being at least partially unbounded at a bottom side of said golf putter head; and a center of gravity of said golf putter head being located closer to said trailing section than to said leading section.

2. The golf putter head of claim 1, further comprising a soleplate that connects a bottom edge of said leading section with a bottom edge of said trailing section, said soleplate being normal to said web.

3. The golf putter head of claim 2, said soleplate partially bounding said first cavity and said second cavity.

4. The golf club head of claim 1, said web having a sighting line that a golfer may use when lining up a putt.

5. The golf putter head of claim 1, said first breadth being about 4 inches.

6. The golf putter head of claim 1, wherein said golf putter head has a weight that does not exceed 350 grams.

7. The golf putter head of claim 1, wherein said golf putter head has a weight that does not exceed 350 grams and a moment of inertia greater than 4,000 gm $cm^2$.

8. The golf putter head of claim 1, said weight means being formed from copper.

9. The golf putter head of claim 1, said weight means being formed from tungsten.

10. The golf putter head of claim 1, said weight means being formed from a tungsten and copper alloy.

11. A golf putter head comprising:

a leading section for striking a golf ball, said leading section having a first breadth;

a trailing section having a second breadth that is less than said first breadth;

a first wall that connects a first end of said leading section with a first end of said trailing section;

a second wall that connects a second end of said leading section with a second end of said trailing section;

said leading section, said trailing section, said first wall, and said second wall defining a triangular-shape of said golf putter head;

a web normal to a longitudinal axis of said leading section and that connects said leading section and said trailing section, said web being located along an axis of symmetry of said putter head;

a weight means located at said trailing section and along said axis of symmetry;

a first cavity for reducing a weight of said golf putter head at an area between said leading section and said trailing section;

said first cavity for reducing a weight of said golf putter head at an area between said leading section and said trailing section;

said first cavity being at least partially bounded by said first wall and said web;

said first cavity being at least partially unbounded at a top side of said golf putter head;

said first cavity being at least partially unbounded at a bottom side of said golf putter head;

said first cavity being at least partially unbounded at a bottom side of said golf putter head;

a second cavity for reducing a weight of said golf putter head at another area between said leading section and said trailing section;

said second cavity being located on a second side of said web that is opposite from said first side of said web, said second cavity being located between said leading section and said trailing section;

said second cavity being at least partially bounded by said second wall and said web;

said second cavity being at least partially unbounded at a top side of said golf putter head;

said second cavity being at least partially unbounded at a bottom side of said golf putter head;

a center of gravity of said golf putter head being located closer to said trailing section than to said leading section; and said golf putter head having a moment of inertia greater than 4,000 gm $cm^2$.

12. The golf putter head of claim 11, said moment of inertia being approximately 5860 gm $cm^2$.

13. The golf putter head of claim 11, said moment of inertia being approximately 6800 gm $cm^2$.

14. The golf putter head of claim 11, said moment of inertia being approximately 7200 gm $cm^2$.

15. A golf putter head comprising:

a triangular-shaped body having a hollow interior;

said hollow interior being defined by at least one cavity that passes entirely through said body;

said triangular-shaped body having a leading section of a first breadth;

said triangular-shaped body having a trailing section having a second breadth that is less than said first breadth;

said triangular-shaped body having a first wall that connects a first end of said leading section with a first end of said trailing section;

said triangular-shaped body having a second wall that connects a second end of said leading section with a second end of said trailing section;

said triangular-shaped body having a soleplate that transmits force from said leading section to said trailing section;

said soleplate being located along an axis of symmetry of said putter head;

said first wall, said second wall, and said soleplate each at least partially bounding at least one cavity;

a weight means located at said trailing section; and a center of gravity of said golf putter head being located closer to said trailing section than to said leading section.

16. The golf club head of claim 15, said soleplate partially bounding said at least one cavity.

17. The golf putter head of claim 15, said triangular-shaped body including a web.

18. The golf club head of claim 16, said at least one cavity including a first cavity and a second cavity located on opposite sides of said web.

19. The golf putter head of claim 15, said first breadth being about 4 inches.

20. The golf putter head of claim 15, wherein said golf putter head has a weight that does not exceed 350 grams.

21. The golf putter head of claim 15, wherein said golf putter head has a moment of inertia greater than 4,000 gm $cm^2$.

22. The golf putter head of claim 15, wherein said golf putter head has a weight that does not exceed 350 grams and a moment of inertia greater than 4,000 gm $cm^2$.

23. The golf putter head of claim 15, said weight means being formed from copper.

24. The golf putter head of claim 15, said weight means being formed from tungsten.

25. The gold putter head of claim 15, said weight means being formed from a tungsten and copper alloy.

26. A golf putter head comprising:

a leading section for striking a golf ball;

said leading section having a first breadth not greater than 4 inches;

a trailing section having a second breadth that is less than said first breadth;

a first wall that connects a first end of said leading section with a first end of said trailing section;

a second wall that connects a second end of said leading section with a second end of said trailing section;

said leading section, said trailing section, said first wall, and said second wall defining a triangular-shape of said golf putter head;

a web located normal to a longitudinal axis of said leading section;

said web connecting said leading section and said trailing section;

said web being located along an axis of symmetry of said putter head;

a soleplate located normal to said leading section and said trailing section;

a weight means located at said trailing section and along said axis of symmetry;

a first cavity for reducing a weight of said golf putter head at an area between said leading section and said trailing section;

a first cavity being located on a first side of said web and between said leading section and said trailing section;

said first cavity being at least partially bounded by said first wall, said web, and said soleplate;

said first cavity being at least partially unbounded at a top side of said golf putter head;

a second cavity for reducing a weight of said golf putter head at another area between said leading section and said trailing section;

said second cavity being located on a second side of said web and between said leading section and said trailing section;

said second cavity being at least partially bounded by said second wall, said web, and said soleplate;

said second cavity being at least partially unbounded at a top side of said golf putter head; and a center of gravity of said golf putter head being located closer to said trailing section than to said leading section.

27. A golf putter head, comprising:

a triangular-shaped body having a leading section, a trailing section, and a hollow interior, the leading section having a breadth no greater than 4 inches;

a web normal to a longitudinal axis of said leading section and located along an axis of symmetry of said putter head, the web having a top surface that is flush with a top surface of the leading section;

a weight means located at said trailing section;

a center of gravity located closer to said trailing section than to said leading section of said body; and a moment of inertia greater than 4,000 gm $cm^2$.

28. The golf putter head of claim 27, said golf putter head having a weight that does not exceed 350 grams.

29. The golf putter head of claim 27, said hollow interior being defined by one cavity.

30. The golf putter head of claim 29, said one cavity being at least partially unbounded at a top side of said golf putter head.

31. The golf putter head of claim 29, said one cavity being at least partially unbounded at a sole side of said golf putter head.

32. The golf putter head of claim 27, said hollow interior being defined by two cavities.

33. The golf putter head of claim 32, each of said two cavities being at least partially unbounded at a top side of said golf putter head.

34. The golf putter head of claim 32, each of said two cavities being at least partially unbounded at a sole side of said golf putter head.

35. The golf putter head of claim 27, said triangular-shaped body including a sighting line that a golfer may use when lining up a putt.

36. The golf putter head of claim 35, said sighting line extending from said leading section to said trailing section.

37. The golf putter head of claim 27, wherein the triangular-shaped body also comprises two sidewalls extending between the leading section and the trailing section, the top surface of the web being flush with a top surface of each of the two sidewalls.

38. The golf putter head of claim 27, further comprising a groove extending along at least a portion of the top surface of the web and along at least a portion of the top surface of the leading section to provide a sighting line.

39. A golf putter head, comprising:

a triangular-shaped body having a trailing section and a leading section, the leading section having a breadth no greater than 4 inches;

a web positioned between the leading section and the trailing section, the web being located alone an axis of symmetry of said cutter head, the web having a too surface that is flush with a too surface of the leading section; and means for locating a center of gravity of said putter closer to said trailing section than to said leading section and for dictating that a moment of inertia of said golf putter head is greater than 4,000 gm $cm^2$.

40. The golf putter head of claim 27, wherein the triangular-shaped body also comprises two sidewalls extending between the leading section and the trailing section, the top surface of the web being flush with a top surface of each of the two sidewalls.

41. The golf putter head of claim 39, further comprising a groove extending along at least a portion of the top surface of the web and along at least a portion of the top surface of the leading section to provide a sighting line.

42. A golf putter head comprising:

a leading section for striking a golf ball, said leading section having a first breadth;

a trailing section having a second breadth that is less than said first breadth;

a first wall that connects a first end of said leading section with a first end of said trailing section;

a second wall that connects a second of said leading section with a second end of said trailing section;

said leading section, said trailing section, said first wall, and said second wall defining a triangular-shape of said golf putter head;

a web normal to a longitudinal axis of said leading section and that connects said leading section and said trailing section, said web being located along an axis of symmetry of said putter head, the web having a top surface that is flush with a top surface of the leading section;

a weight means located at said trailing section and along said axis of symmetry;

a first cavity for reducing a weight of said golf putter head at an area between said leading section and said trailing section;

said first cavity being located on a first side of the web between said leading section and said trailing section;

said first cavity being at least partially bounded by said first wall and said web;

said first cavity being at least partially unbounded at a top side of said golf putter head;

said first cavity being at least partially unbounded at a bottom side of said golf putter head;

a second cavity for reducing a weight of said golf putter head at another area between said leading section and said trailing section;

said second cavity being located on a second side of said web that is opposite from said first side of said web, said second cavity being located between said leading section and said trailing section;

said second cavity being at least partially bounded by said second wall and said web;

said second cavity being at least partially unbounded at a top side of said golf putter head; and said second cavity being at least partially unbounded at a bottom side of said golf putter head.

43. The golf putter head of claim 42, wherein said golf putter head has a weight that does not exceed 350 grams and a moment of inertia of at least 4000 g $cm^2$.

44. The golf putter head of claim 42, including a groove extending along the entire top of the web to provide a sighting line for a user.

45. The golf putter head of claim 42, wherein the first breadth of the leading section does not exceed 4 inches.

46. The golf putter head of claim 42, further comprising a groove extending along at least a portion of the top surface of the web and along at least a portion of the top surface of the leading section to provide a sighting line.

* * * * *